United States Patent [19]

Stenvall

[11] Patent Number: 4,822,103

[45] Date of Patent: Apr. 18, 1989

[54] ARM REST DEVICE

[76] Inventor: Kurt Stenvall, Blåvägen, Stensele, Sweden, S-920 53

[21] Appl. No.: 193,540

[22] Filed: May 13, 1988

[51] Int. Cl.[4] ..... A47C 7/54

[52] U.S. Cl. ..... 297/411; 248/118; 248/118.5; 297/412; 297/463

[58] Field of Search ..... 297/463, 411, 412, 414, 297/415; 248/118.5, 118.3, 118.1, 118

[56] References Cited

U.S. PATENT DOCUMENTS

| | | | |
|---|---|---|---|
| 1,706,634 | 3/1929 | Seils . | |
| 3,063,752 | 11/1962 | Moore | 297/463 X |
| 4,069,995 | 1/1978 | Miller | 248/118.1 |

FOREIGN PATENT DOCUMENTS

| | | | |
|---|---|---|---|
| 452585 | 10/1927 | Fed. Rep. of Germany . | |
| 57540 | 7/1891 | Fed. Rep. of Germany | 248/118.5 |
| 1082209 | 6/1954 | France | 248/118 |
| 403700 | 9/1978 | Sweden . | |

*Primary Examiner*—James T. McCall

*Attorney, Agent, or Firm*—Nixon & Vanderhye

[57] ABSTRACT

An arm rest device for relieving load when performing work by hand and wrist movements comprises an attachment member for mounting the arm rest on a chair; an upper support for supporting the forearm and arranged to be self-positioning while supporting the forearm and work being performed by hand and wrist movements, said support accompanying the hand and wrist movements; an adjustable horizontal guide rail attached to said upper support and movably disposed in longitudinal direction to provide a corresponding adjustment of said support due to the influence of a force generated when the hand is moved forwards or backwards; an adjustable vertical guide rail which is movable in its longitudinal direction to provide a corresponding adjustment of said support due to the influence of a force generated by the weight of the forearm and by external forces exerted on the forearm; and a joint of elastic material arranged below said horizontal guide rail, carrying said horizontal guide rail and said support, said elastic joint being arranged to allow said horizontal guide rail to tilt in order to provide corresponding adjustment of said support due to the action of forces applied on said support in front of and behind said joint via the forearm, said horizontal guide rail, said vertical guide rail and said joint being arranged to return to their initial positions when said forces have ceased.

4 Claims, 3 Drawing Sheets

ARM REST DEVICE

FIELD AND BACKGROUND OF THE INVENTION

The present invention relates to an arm rest device for relieving load on parts of the human body when performing work by hand and wrist movements.

Such work by hand and wrist movements is carried out in connection with actuation of the joy stick or key of a control lever of vehicles, such as tractors, and buttons and keys of cash registers, terminals and the like apparatus.

The overloading of the muscles in shoulders and neck is a cause of the most usual occupational injuries. The risk is particularly great if the movements are small but at the same time require precision. The movements give rise to considerable stress in shoulders and neck. Equipment available today, such as adjustable arm rests which can be set in suitable positions, offer a certain amount of relief but are in no way sufficient except in certain very specific applications. The problem is often that the support does not follow all the movements performed. U.S. Pat. No. 1,706,634, German Pat. No. 452.585 and Swedish Pat. No. 403,700 represent this prior art. Another alternative is to suspend the forearm in a balance block, thus obtaining relief. However, the technique available today does not offer sufficient relief to the muscles affected.

SUMMARY OF THE INVENTION

The object of the present invention is to provide an improved arm rest device for supporting the forearm in order to relieve efficiently the shoulder and neck when work is being done by hand and wrist movements. It is a further object of the invention to provide an improved arm rest device which can be mounted to chairs and seats of various type. This gives an extremely flexible product with a plurality of applications.

According to the invention, said objects are achieved by means of an arm rest device for relieving load on parts of the human body when performing work by hand and wrist movements, said device comprises an attachment member for mounting the arm rests onto a chair or the like; an upper support for supporting the forearm and arranged to be self-positioning while supporting the forearm and work being performed by hand and wrist movements, said support accompanying the hand and wrist movements; an adjustable horizontal guide rail attached to said upper support and movably disposed in longitudinal direction to provide a corresponding adjustment of said support due to the influence of a force generated when the hand is moved forwards or backwards; an adjustable vertical guide rail which is movable in its longitudinal direction to provide a corresponding adjustment of said support due to the influence of a force generated by the weight of the forearm and by external forces exerted on the forearm; and a joint of elastic material arranged below said horizontal guide rail, carrying said horizontal guide rail and said support, said elastic joint being arranged to allow said horizontal guide rail to tilt in order to provide corresponding adjustment of said support due to the action of forces applied on said support in front of or behind said joint via the forearm, said horizontal guide rail, said vertical guide rail and said joint being arranged to return to their initial positions when said forces have ceased.

BRIEF DESCRIPTION OF THE DRAWINGS

The invention will be described further in the following with reference to the accompanying drawings.

With reference to FIGS. 1 to 3 it is shown therein an arm rest device comprising as main elements an upper support 1, a first guide rail 2, a second guide rail 3, an attachment member 4 and an elastic joint 5.

Figure 3:
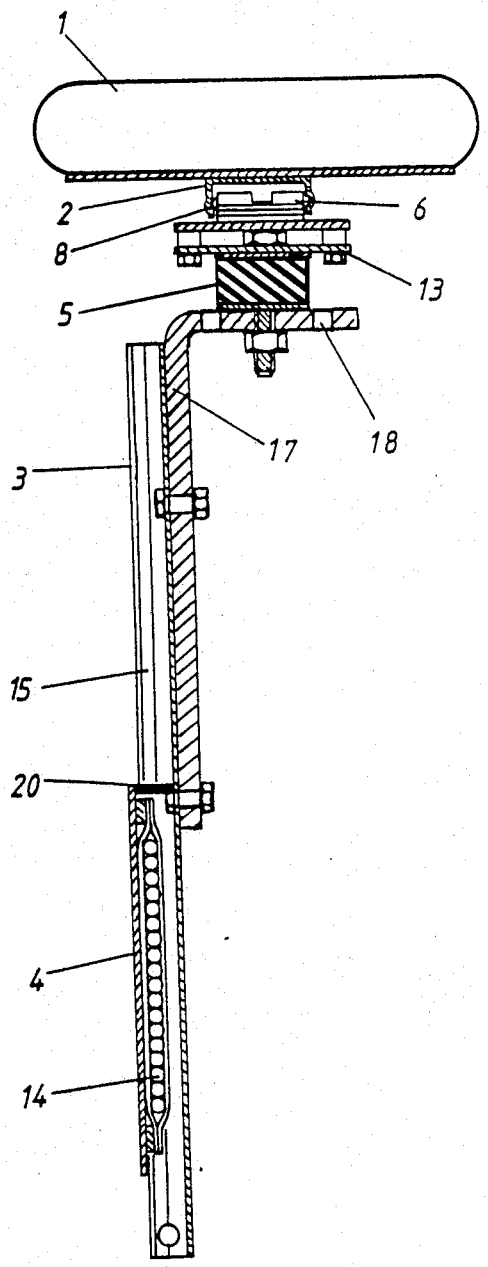
FIG. 3 is an elevation sectional view of the arm rest device.

The attachment member 4 is in the form of a plate designed for rigidly mounting the arm rest device onto a chair, for instance, and provided with opposite ball bearings 14 vertically disposed for linear movement of the second guide rail 3 as shown in FIG. 3.

The upper support 1 is designed for supporting the forearm of the operator and is arranged to be self-positioning while supporting the forearm and a work is performed by moving the hand and wrist, i.e. the support 1 follows completely the movements of the hand and wrist so that the support and forearm are unitary.

The first guide rail 2 has a horizontal position and is adjustable in its longitudinal direction. It is rigidly attached to the lower surface of the support 1 so that the support 1 and the horizontal guide rail 2 form a unitary part. The horizontal guide rail 2 is movably disposed in longitudinal direction to provide a corresponding adjustment of the support due to the influence of forces generated when the hand is moved forwards or backwards.

Figure 2:
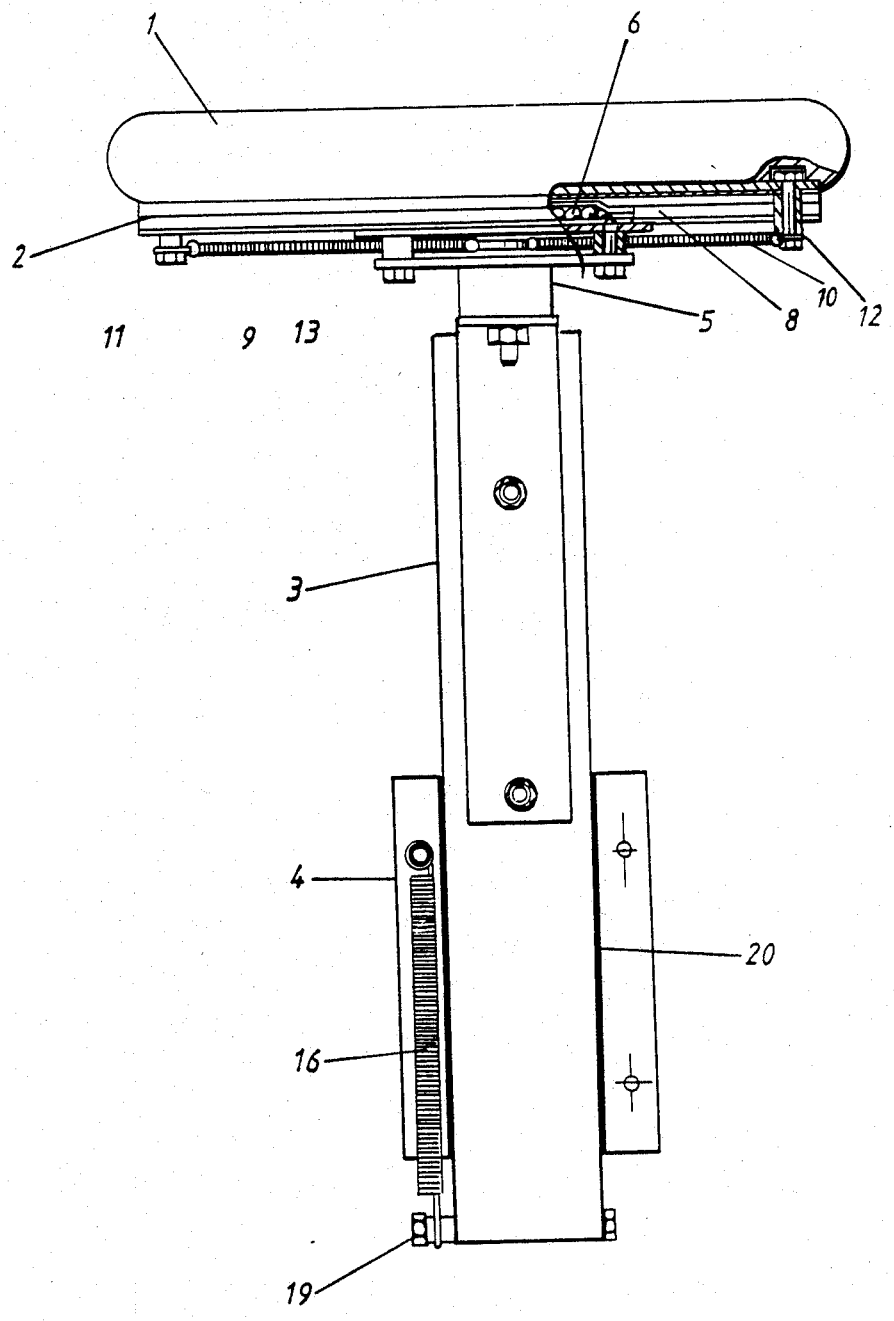
FIG. 2 is an elevation side view of an arm rest device according to FIG. 1, partially sectioned.

The second guide rail 3 has a vertical position and is adjustable in its longitudinal direction with respect to the attachment member 4. Thus, it is movable in its longitudinal direction to provide a corresponding adjustment of the support 1 due to the influence of forces generated by the weight of the forearm and by external forces exerted on the forearm. The vertical guide rail 3 is provided with opposite longitudinal grooves 15 for receiving said ball bearings 14 of the attachment member 4 when the vertical guide rail 3 is in engagement with the attachment member 4. By means of the ball bearings 14 there will be low friction so that the vertical guide rail 3 can be moved easily up and down in the plate 4. A spring 16 is with its one end attached to the plate 4 and with its other end to the lower end of the vertical guide rail 3 via a bolt 19. As shown in FIG. 2 the spring 16 keeps the support 1 in its uppermost position when no force is influencing the support 1 in downwardly direction.

A bracket 17 is attached to the vertical guide rail 3 by means of bolts. The elastic joint 5 is mounted by means of a vertical bolt onto the horizontal part of the bracket 17, said horizontal part being provided with a plurality of holes 18 allowing different side positions of the support. These holes provide increased flexibility of lateral adjustments. Said lateral bolt also attaches a holder 13 to the bracket, the elastic joint 5 being disposed therebetween. The elastic joint 5 consists of a yieldable material, such as rubber. The holder 13 includes a member attached onto the upper side of the holder 13 and being provided with two opposite ball bearings horizontally disposed for linear movement of the horizontal guide rail 2 with respect to the holder 13, the guide rail being provided with opposite grooves 8 along which the ball bearings run. Two opposite springs 9, 10 keep the support and horizontal guide rail 2 in a position of equilibrium when not actuated by any external force. The one end of each spring 9, 10 is attached to a bolt 11 and 12, respectively, mounted to the horizontal guide rail 2 at a distance from the holder 13, whereas the other end of each spring is attached to the holder 13 or to the vertical bolt which attaches the holder 13 to the bracket 17. The bolts 11, 12 also function as stops to prevent the support 1 and horizontal guide rail 2 from leaving the holder 13. By means of said ball bearings 6 there will be very low friction so that the support 1 moves very easy along the holder 13.

The ball bearings 14 mounted to the plate 4 is protected from particles of dirt by means of a seal 20. Such dirt might in other case impede the vertical movement of the support 1 and associated parts.

Figure 1:
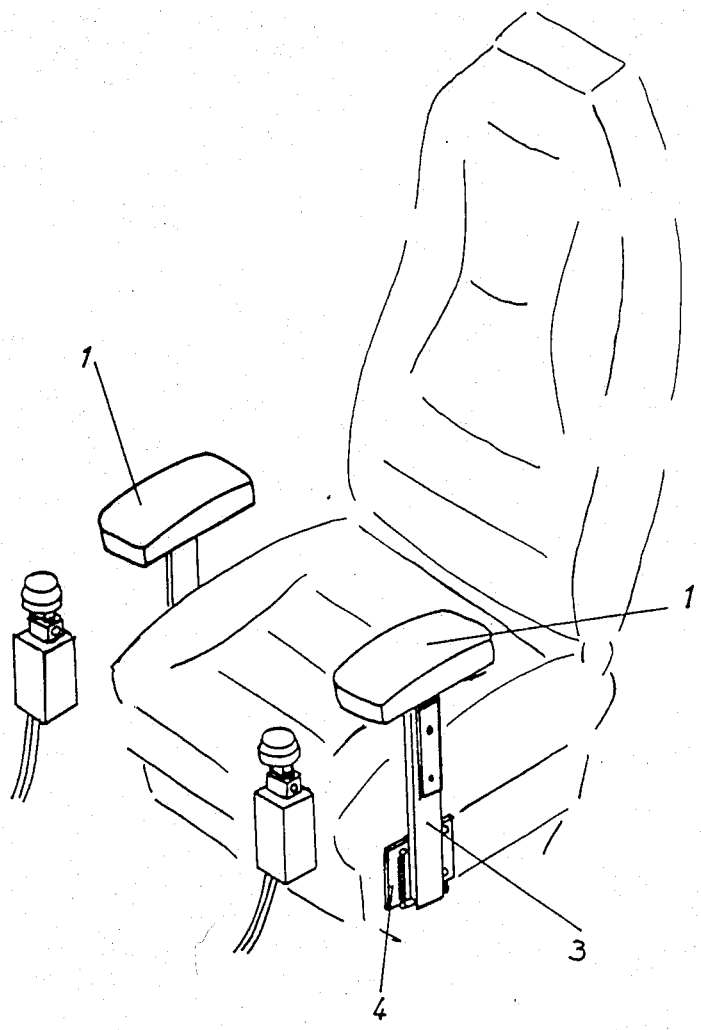
FIG. 1 illustrates schematically a driving seat equipped with two arm rest devices according to the invention, two control levers being disposed in front of the seat.

The arm rest device functions in such a way that the support 1 is always in contact with the forearm when movements are performed by the hand and wrist including the fingers and forearm. FIG. 1 illustrates a driving seat of a vehicle having two control levers in front of the seat to be operated by the driver. Thus, in this case the seat is equipped with two arm rest devices according to the present invention. When the joy stick of the control lever is moved forwards or backwards the forearm and the support will be moved correspondingly as a unit provided that the forearm is resting on the support 1. When a force is applied on the front end portion of the support 1 the support will turn or tilt about the joint 5 forming the centre of this torsional movement. When a force, such as the weight of the forearm and the force applied on the joy stick is applied and forwarded, respectively, to the support 1, the support 1 will be pressed down via the joint 5, bracket 17 and vertical guide rail 3, whereby the spring 16 will be stretched. The downward movement continuous until an equilibrium is reached.

The support 1 of the arm rest device is thus movable for self-adjustment in horizontal direction, vertical direction and turnable for self-adjustment about a centre defined by the elastic joint 5. The arm rest device provides increased freedom of movement in order to relieving the shoulder and neck muscles in an efficient way.

That which is claimed is:

1. An arm device for relieving load on parts of the human body, when performing work by hand and wrist movements, comprising an attachment member for mounting the arm rest onto a chair or the like; an upper support for supporting the forearm and work being performed by hand and wrist movements; an adjustable horizontal guide rail attached to said upper support and movably disposed in longitudinal direction to provide a corresponding adjustment of said support due to the influence of a force generated when the hand is move forwards or backwards; an adjustable vertical guide rail which is movable in its longitudinal direction to provide a corresponding adjustment of said support due to the influence of a force generated by the weight of the forearm and by external forces exerted on the forearm; and a joint of elastic material arranged between said horizontal guide rail and said vertical guide rail, said elastic joint carrying said horizontal guide rail and said support, said elastic joint allowing said horizontal guide rail to tilt about the elastic joint in order to provide corresponding adjustment of said support due to the action of forces applied on said support in front of or behind said joint via the forearm, said horizontal guide rail, said vertical guide rail and said joint being arranged to return to their initial positions when said forces have ceased.

2. An arm rest device as claimed in claim 1 wherein said guide rails are journalled by means of ball bearings.

3. An arm rest device as claimed in claim 1 wherein said guide rails are provided with springs mounted to return the support to its initial position horizontally and vertically.

4. An arm device for relieving load on parts of the human body, when performing work by hand and wrist movements, comprising an attachment member for mounting the arm rest onto a chair or the like; an upper support for supporting the forearm and work being performed by hand and wrist movements; an adjustable horizontal guide rail attached to said upper support and movably disposed in longitudinal direction to provide a corresponding adjustment of said support due to the influence of a force generated when the hand is move forwards or backwards; an adjustable vertical guide rail which is movable in its longitudinal direction to provide a corresponding adjustment of said support due to the influence of a force generated by the weight of the forearm and by external forces exerted on the forearm; and a joint of elastic material arranged below said horizontal guide rail, carrying said horizontal guide rail and said support, said elastic joint being arranged to allow said horizontal guide rail to tilt in order to provide corresponding adjustment of said support due to the action of forces applied on said support in front of or behind said joint via the forearm, said horizontal guide rail, said vertical guide rail and said joint being arranged to return to their initial positions when said forces have ceased, and wherein said horizontal and vertical guide rails are journalled by means of ball bearings.

* * * * *